US008330552B2

(12) United States Patent
Li et al.

(10) Patent No.: US 8,330,552 B2
(45) Date of Patent: Dec. 11, 2012

(54) SANDWICH STRUCTURE FOR DIRECTIONAL COUPLER

(75) Inventors: Yang Li, Woburn, MA (US); Xuanang Zhu, Nashua, NH (US); Dmitri Prikhodko, Reading, MA (US)

(73) Assignee: Skyworks Solutions, Inc., Woburn, MA (US)

( * ) Notice: Subject to any disclaimer, the term of this patent is extended or adjusted under 35 U.S.C. 154(b) by 341 days.

(21) Appl. No.: 12/821,624

(22) Filed: Jun. 23, 2010

(65) Prior Publication Data

US 2011/0316646 A1 Dec. 29, 2011

(51) Int. Cl.
*H01P 5/18* (2006.01)
*H01P 3/08* (2006.01)

(52) U.S. Cl. ..... 333/116; 333/238

(58) Field of Classification Search ..... 333/109, 333/113, 115, 116, 238
See application file for complete search history.

(56) References Cited

U.S. PATENT DOCUMENTS

| | | | | |
|---|---|---|---|---|
| 6,756,860 | B2 * | 6/2004 | Shin | 333/116 |
| 7,075,387 | B2 | 7/2006 | Paakkonen et al. | |
| 2002/0113667 | A1 | 8/2002 | Tahara et al. | |
| 2008/0070519 | A1 | 3/2008 | Okabe | |
| 2009/0027143 | A1 | 1/2009 | Jensen et al. | |

* cited by examiner

*Primary Examiner* — Dean O Takaoka
(74) *Attorney, Agent, or Firm* — Lando & Anastasi, LLP

(57) ABSTRACT

A sandwich strip coupled coupler implemented in a multi-layer substrate, such as a multi-layer printed circuit board. In one example, the sandwich strip coupled coupler includes a main arm having a first main arm section and a second main arm section disposed above the first main arm section, the first and second main arm sections being electrically connected together, and a coupled arm disposed between the first and second main arm sections, the first main arm section, the coupled arm and the second main arm section forming a sandwich structure.

20 Claims, 9 Drawing Sheets

SANDWICH STRUCTURE FOR DIRECTIONAL COUPLER

BACKGROUND

1. Field of Invention

The present invention relates generally to the field of electronic transmission line devices and, more particularly, to directional couplers.

2. Discussion of Related Art

Directional couplers are passive devices used in many radio frequency (RF) applications, including for example, power amplifier modules. Directional couplers couple part of the transmission power in a transmission line by a known amount out through another port, in the case of microstrip or stripline couplers by using two transmission lines set close enough together such that energy passing through one is coupled to the other. As illustrated in FIG. 1, a directional coupler 100 has four ports, namely an input port P1, a transmitted port P2, a coupled port P3, and an isolated port P4. The term "main line" refers to the transmission line section 110 of the coupler between ports P1 and P2. The term "coupled line" refers to the transmission line section 120 that runs parallel to the main line 110 and between the coupled port P3 and the isolated port P4. Often the isolated port P4 is terminated with an internal or external matched load, for example, a 50 Ohm or 75 Ohm load. It is to be appreciated that since the directional coupler is a linear device, the notations on FIG. 1 are arbitrary. Any port can be the input port, which will result in the directly connected port being the transmitted port, the adjacent port being the coupled port, and the diagonal port being the isolated port (for stripline and microstrip couplers).

Microstrip and stripline couplers are widely implemented in power amplifier modules, particularly those used in telecommunications applications, using multi-layer laminate printed circuit boards (PCBs) due to ease of fabrication and low cost. Conventionally, these couplers are realized by placing the main RF line 210 and the coupled line 220 on two vertically adjacent PCB layers and maintaining overlap of the two structures to provide the RF coupling, as shown in FIG. 2.

SUMMARY OF INVENTION

Aspects and embodiments are directed to a strip coupled coupler design in which a specified coupling factor can be achieved with a reduced-size coupler, relative to conventional strip coupled coupler designs, and which also maintains high directivity. According to one embodiment, a "sandwich" structure is used to provide stronger coupling between main line and secondary/coupled line, where the main line is implemented in two layers that are connected by vias and the secondary arm is located in between the two main line layers, as discussed further below.

According to one embodiment, a multi-layer strip coupled coupler comprises a first main arm section formed in a first metal layer in a multi-layer substrate, a second main arm section formed in a second metal layer above the first metal layer in the multi-layer substrate, the second main arm section being vertically aligned with and electrically connected in parallel to the first main arm section, and a coupled arm formed in a third metal layer in the multi-layer substrate, the coupled arm disposed between the first and second main arm sections, the coupled arm being separated from the first main arm section by a first dielectric layer and separated from the second main arm section by a second dielectric layer. The first main arm section, the coupled arm and the second main arm section are vertically aligned in the multi-layer substrate and form a sandwich structure. The multi-layer strip coupled coupler further comprises a first via located proximate an input of the first main arm section that electrically connects the first and second main arm sections in parallel, and a second via located proximate a distal end, relative to the input, of the first and second main arm sections that electrically connects the first and second main arm sections in parallel. In one example, the multi-layer substrate is a multi-layer printed circuit board. In one example, the coupled arm is located between the first and second vias. In another example, current flow in the first and second main arm sections is in a same direction. In another example, the first and second main arm sections and the coupled arm comprise copper traces.

According to one embodiment of a strip coupled coupler formed in a multi-layer printed circuit board, the strip-coupled coupler comprises a first main line section formed in a first layer of the multi-layer printed circuit board, a second main line section formed in a second layer of the multi-layer printed circuit board, a coupled line formed in a third layer of the multi-layer printed circuit board, the third layer being disposed between the first and second layers and the coupled line being disposed between the first and second main line sections, and the coupled line, the first main line section and the second main line section being vertically aligned, and at least one via that electrically connects the first main line section to the second main line section in parallel.

In one example of the strip coupled coupler, the first, second and third layers are metal layers of the multi-layer printed circuit board. The first and second main line sections and the coupled line may be printed copper or gold traces, for example. In one example, the at least one via comprises a first via located proximate a proximal end of the first main line section and a second via located proximate a distal end of the first main line section. In one example, the coupled line is located between the first and second vias. The strip coupled coupler may further comprise an input port coupled to a proximal end of each of the first main line section and the second main line section, and a coupled port coupled to a proximal end of the coupled line, the proximal end of the coupled line being at a same end of the strip coupled coupler as the proximal end of the first and second main line sections. In another example, the strip coupled coupler further comprises a transmitted port coupled to a distal end of the first and second main line sections, and an isolated port coupled to a distal end of the coupled line. The isolated port may be terminated in a matched load. In one example, current flow in the first and second main line sections is in the same direction from the input port to the transmitted port.

According to another embodiment, a sandwich strip coupled coupler comprises a main arm including a first main arm section and a second main arm section disposed above the first main arm section, the first and second main arm sections being electrically connected together in parallel, and a coupled arm disposed between the first and second main arm sections, the first main arm section, the coupled arm and the second main arm section being vertically aligned with one another and forming a sandwich structure.

In one example, the sandwich strip coupled coupler further comprises at least one via that electrically connects the first and second main arm sections. In another example, the sandwich strip coupled coupler is implemented in a multi-layer printed circuit board, wherein the first main arm section is disposed in a first metal layer of the multi-layer printed circuit board, wherein the second main arm section is disposed in a second metal layer of the multi-layer printed circuit board, the second metal layer disposed above the first metal layer, and wherein the coupled arm is disposed in a third metal layer of the multi-layer printed circuit board, the third metal layer disposed above the first metal layer and below the second metal layer. In one example, the at least one via comprises a first via located proximate a proximal end of the first and second main arm sections, and a second via located proximate a distal end of the first and second main arm sections. The sandwich strip coupled coupler may further comprise an input port coupled to the proximal end of the first and second main arm sections and a transmitted port coupled to the distal end of the first and second main arm sections. In one example, current flow in the first and second main arm sections is in a same direction, from the input port to the transmitted port.

Still other aspects, embodiments, and advantages of these exemplary aspects and embodiments, are discussed in detail below. Any embodiment disclosed herein may be combined with any other embodiment in any manner consistent with at least one of the objects, aims, and needs disclosed herein, and references to "an embodiment," "some embodiments," "an alternate embodiment," "various embodiments," "one embodiment" or the like are not necessarily mutually exclusive and are intended to indicate that a particular feature, structure, or characteristic described in connection with the embodiment may be included in at least one embodiment. The appearances of such terms herein are not necessarily all referring to the same embodiment. The accompanying drawings are included to provide illustration and a further understanding of the various aspects and embodiments, and are incorporated in and constitute a part of this specification. The drawings, together with the remainder of the specification, serve to explain principles and operations of the described and claimed aspects and embodiments

BRIEF DESCRIPTION OF THE DRAWINGS

Various aspects of at least one embodiment are discussed below with reference to the accompanying figures, which are not intended to be drawn to scale. Where technical features in the figures, detailed description or any claim are followed by references signs, the reference signs have been included for the sole purpose of increasing the intelligibility of the figures, detailed description, and claims. Accordingly, neither the reference signs nor their absence are intended to have any limiting effect on the scope of any claim elements. In the figures, each identical or nearly identical component that is illustrated in various figures is represented by a like numeral. For purposes of clarity, not every component may be labeled in every figure. The figures are provided for the purposes of illustration and explanation and are not intended as a definition of the limits of the invention. In the figures:

DETAILED DESCRIPTION

To support multi-band and multi-mode applications, architectures for wireless devices, such as cellular telephone handsets, have been proposed in which power detection is shared across multiple frequency bands using "daisy-chained" directional couplers. This necessitates couplers with high directivity as well the same coupling factor across different frequency bands. The coupling factor (in dB) is defined as:

$$C = 10\log\left(\frac{P_3}{P_2}\right)\ \text{dB} \tag{1}$$

Figure 1:
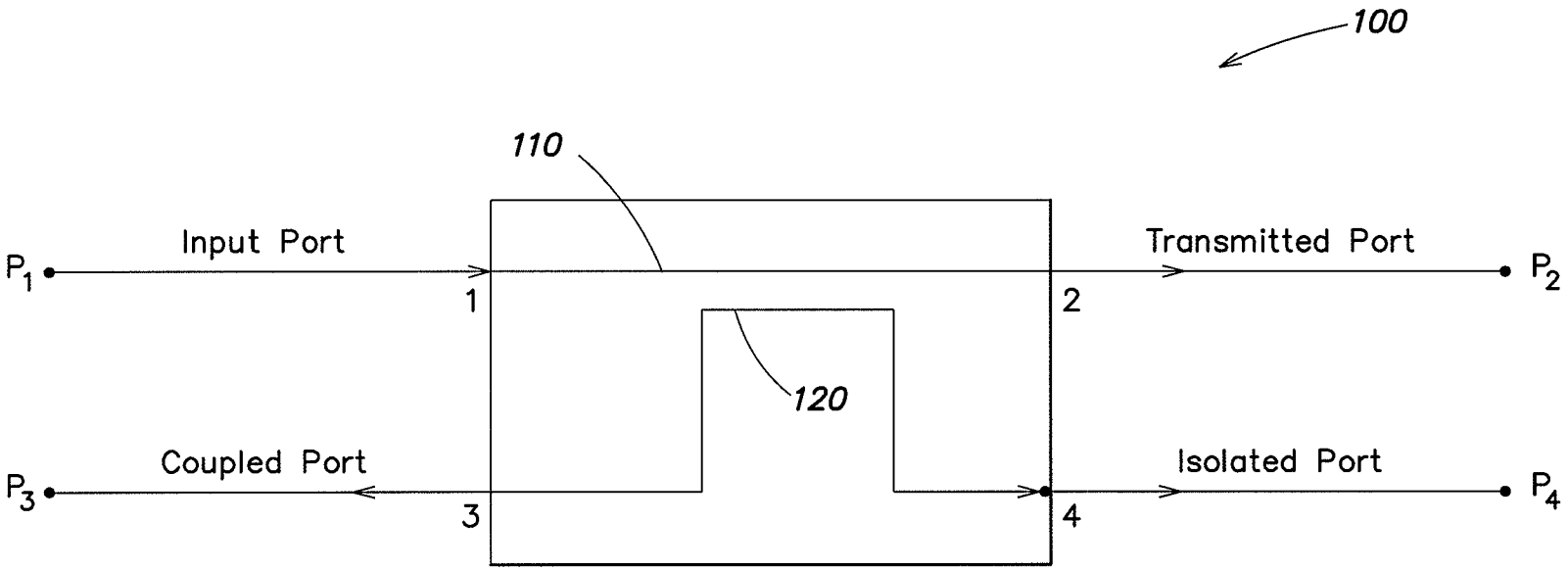
FIG. 1 (Related Art)
FIG. 1 is a block diagram of one example of a directional coupler.
Figure 2:
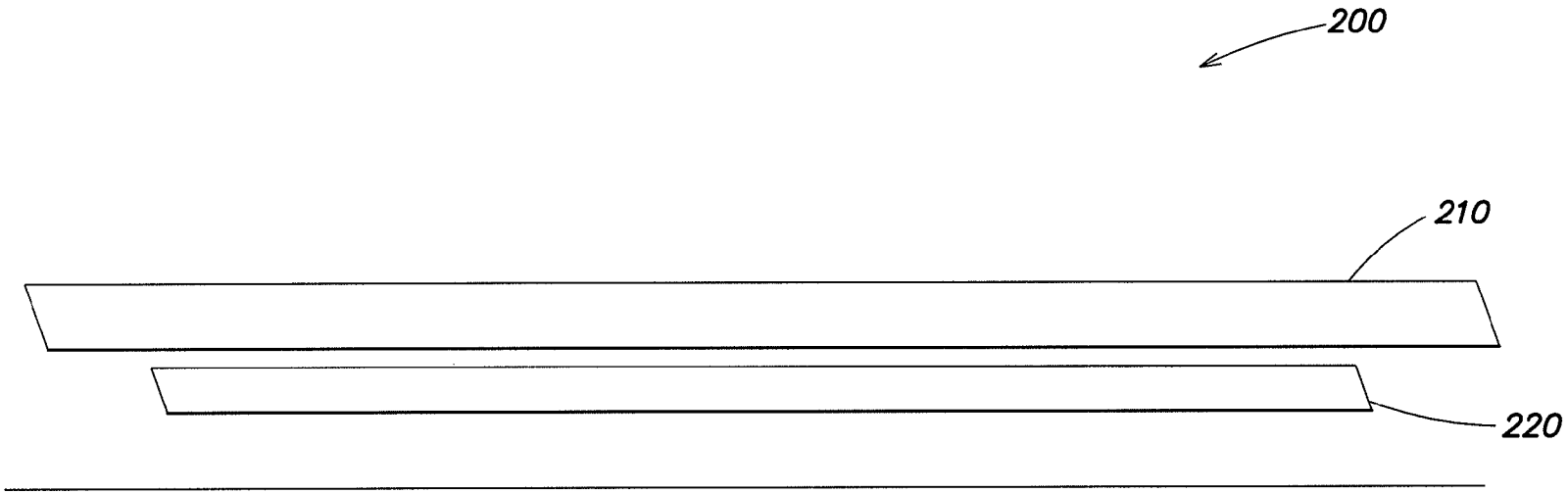
FIG. 2 (Related Art)
FIG. 2 is a diagram of one example of a conventional strip coupled directional coupler implemented on a multi-layer printed circuit board.

In Equation (1), $P_2$ is the power at the transmitted port and $P_3$ is the output power from the coupled port (see FIG. 1). The coupling factor (in dB) can also be expressed in terms of the S parameters of the coupler as:

$$C = \left(\frac{S(3,1)}{S(2,1)}\right)\ \text{dB} \tag{2}$$

In Equation 2, S(3,1) is the transmission parameter from the input port to the coupled port and S(2,1) is the transmission parameter from the input port to the transmitted port. Thus, the coupling factor represents the ratio of the signal at the coupled port to the signal at the transmitted port, for a signal applied at the input port. The coupling factor represents a primary property of a directional coupler. Coupling is not constant, but varies with frequency.

For strip-coupled couplers used in small power amplifier module applications, the coupling factor is approximately proportional to the electrical length of the coupler. Accordingly, in order to meet coupling factor specifications for many applications, couplers with longer electrical lengths are used. However, as power amplifier modules decrease in size, it is becoming challenging to implement sufficiently long couplers to obtain the specified/desired coupling factor, particularly at lower frequency bands, for example, bands in the vicinity of 700 Megahertz (MHz) used in several communications standards. Some implementations achieve increased coupler length by bending the coupler lines; however, this can cause degradation of the directivity of the coupler and also reduces the routing flexibility of output matching networks. Accordingly, aspects and embodiments are directed to a strip coupled coupler design that allows for reduced coupler size while achieving the same coupling factor and also maintaining high directivity. In particular, according to one embodiment, a sandwich structure is used to provide stronger coupling between main line and secondary/coupled line, where the main line is implemented in two layers that are connected by vias and the secondary arm is located in between the two main line layers, as discussed further below.

It is to be appreciated that embodiments of the methods and apparatuses discussed herein are not limited in application to the details of construction and the arrangement of components set forth in the following description or illustrated in the accompanying drawings. The methods and apparatuses are capable of implementation in other embodiments and of being practiced or of being carried out in various ways. Examples of specific implementations are provided herein for illustrative purposes only and are not intended to be limiting. In particular, acts, elements and features discussed in connection with any one or more embodiments are not intended to be excluded from a similar role in any other embodiments.

Also, the phraseology and terminology used herein is for the purpose of description and should not be regarded as limiting. Any references to embodiments or elements or acts of the systems and methods herein referred to in the singular may also embrace embodiments including a plurality of these elements, and any references in plural to any embodiment or element or act herein may also embrace embodiments including only a single element. References in the singular or plural form are not intended to limit the presently disclosed systems or methods, their components, acts, or elements. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms. Any references to front and back, left and right, top and bottom, upper and lower, and vertical and horizontal are intended for convenience of description, not to limit the present systems and methods or their components to any one positional or spatial orientation.

Figure 3:
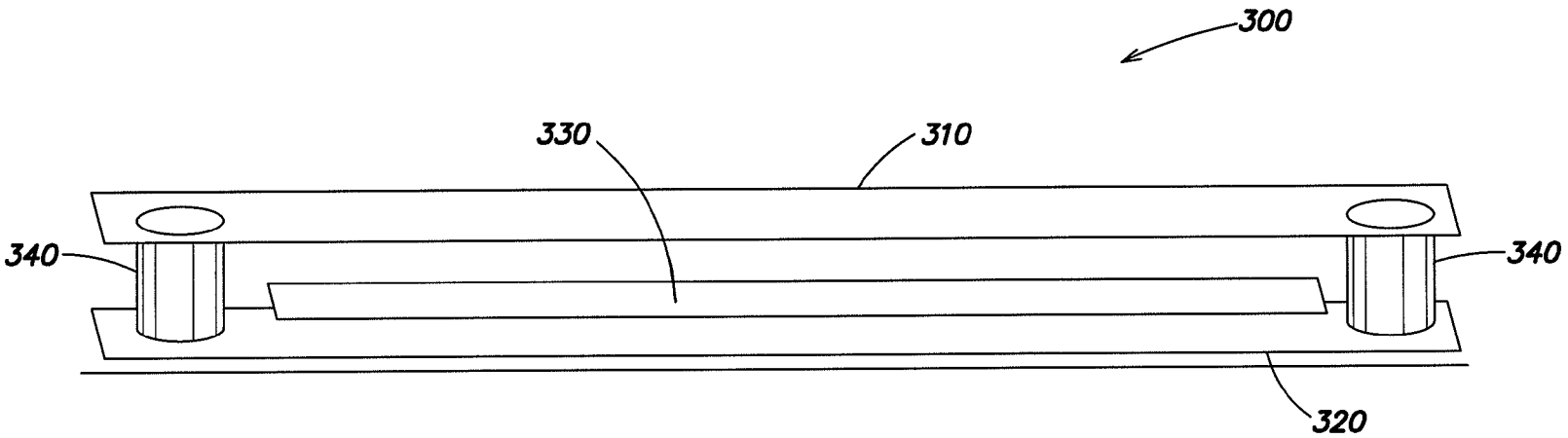
FIG. 3 is a diagram one example of a sandwich strip coupled directional coupler implemented on a multi-layer printed circuit board, according to aspects of the present invention.

Referring to FIG. 3 there is illustrated one example of a strip coupled coupler having a sandwich architecture according to one embodiment. The coupler 300 is implemented as patterned metal transmission lines on an insulating substrate, such as, for example, a multi-layer PCB (not shown), that includes at least three vertically adjacent metal layers, the metal layers being separated from one another by dielectric layers, as known to those skilled in the art. The main arm of the coupler 300 is built in two metal layers of the multi-layer substrate structure and includes a first section 310 and a second section 320 which are respectively disposed above and below the coupled arm 330. The coupled arm 330, the first main arm section 310 and the second main arm section 320 are substantially vertically aligned forming a sandwich structure. The two sections 310, 320 of the main arm are electrically connected together in parallel by vias 340. Thus, current flow in the first and second main arm sections is in the same direction from the input port at one end of the main arm to the transmitted port at the other end of the main arm. In the illustrated example, the coupled arm 330 is located between the vias 340, such that the two main arm sections 310, 320 are coupled together "outside" of the coupled arm 330. In one example, the vias 340 are located at both ends of the main arm sections 310, 320, as shown in FIG. 3. It is to be appreciated that although in FIG. 3 a single via 340 is illustrated at either end of the main arm sections 310, 320, each via 340 may be implemented as one or more physical through-hole plated vias. In addition, alternative connection mechanisms, such as bond wires for example, may be used instead of vias to electrically connect the two main line sections 310, 320 together. Thus, the coupled arm 330 obtains stronger coupling with the main arm through the electromagnetic fields on both the top and bottom sides of the secondary arm. As a result, a shorter length coupler can have the same coupling factor relative to a conventional strip coupled coupler, or alternatively, for the same length coupler, the sandwich structure can achieve a higher coupling factor.

The insulating substrate structure in which the coupler is implemented may include any type of board material suitable for the application in which the coupler is being used, including, for example, FR4 or LTCC. The main lines 310, 320 and coupled line 330 of the coupler may be printed metal traces, for example, copper or gold traces.

Examples of a conventional strip coupled coupler and a sandwich strip coupled coupler have been simulated to illustrate the relative performance and characteristics of an embodiment of the sandwich strip coupled coupler.

Figure 4:
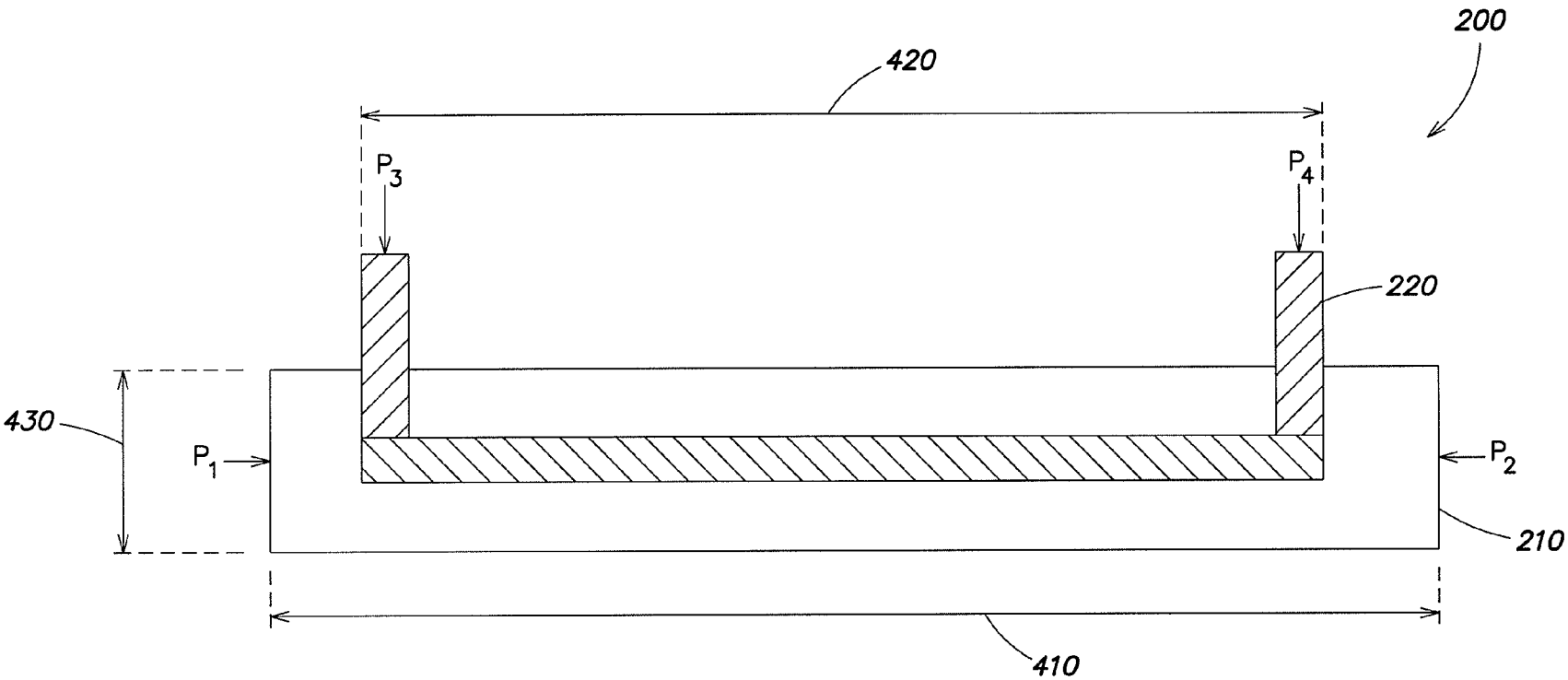
FIG. 4 is a simulation diagram of one example of a conventional strip coupled coupler.

Referring to FIG. 4 there is illustrated a diagram of a simulated conventional strip coupled coupler 200. The coupler 200 has an input port P1, a transmitted port P2, a coupled port P3 and an isolated port P4. The simulation was run over a frequency range of 700 MHz to 800 MHz using Agilent Momentum, a simulation program available from Agilent Technologies. For the simulation, the coupler 200 was specified as having a main arm length 410 of 3.0 millimeters (mm) and a coupled arm length 420 of 2.5 mm.

Figure 5A:
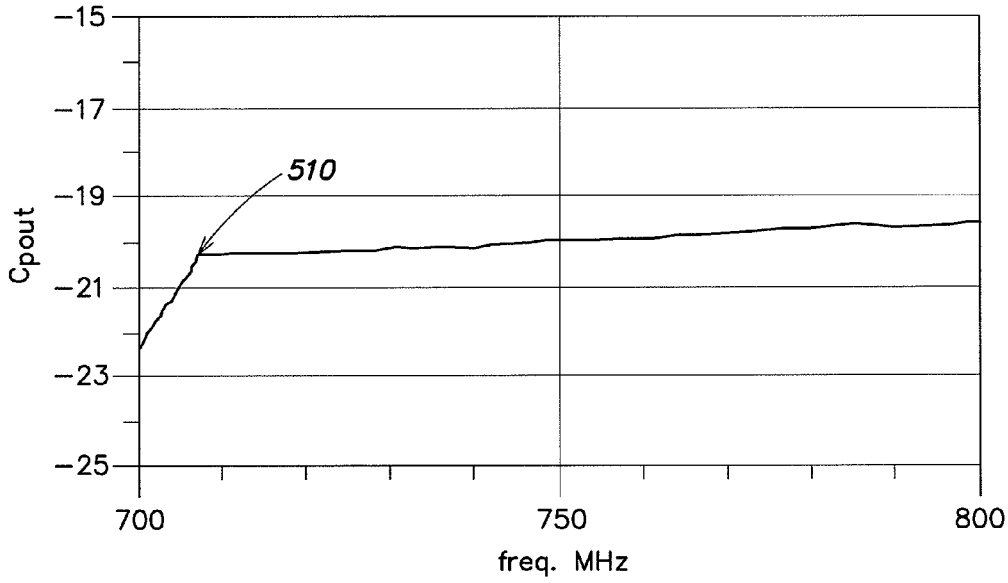
FIG. 5A is a graph of coupling factor as a function of frequency for the simulated conventional strip coupled coupler of FIG. 4.
Figure 5B:
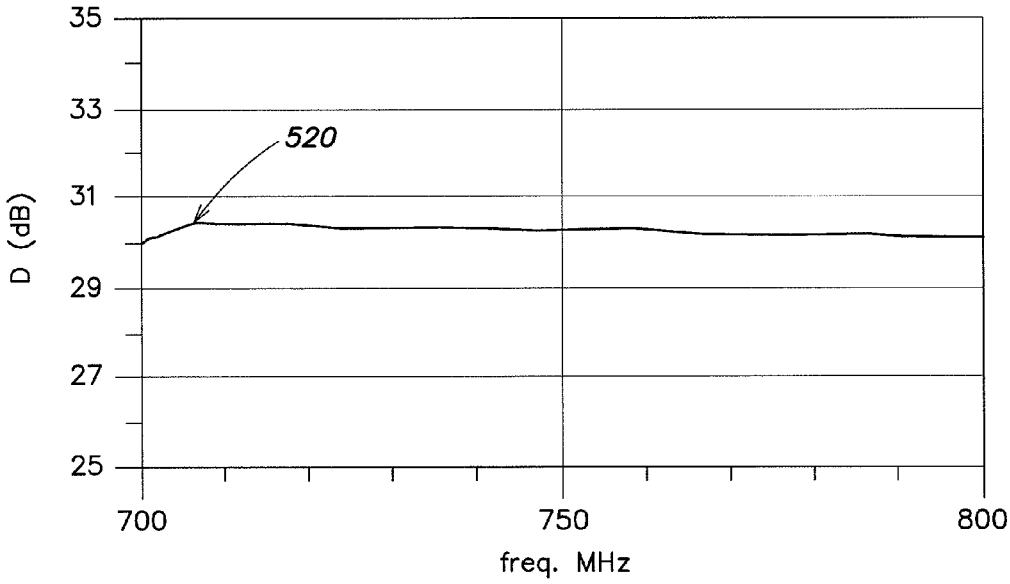
FIG. 5B is a graph of directivity as a function of frequency for the simulated conventional strip coupled coupler of FIG. 4.

FIG. 5A illustrates a graph of the coupling factor in dB ($C_{pout}$) of the coupler 200 as a function of frequency (in MHz) over the simulated frequency range. As can be seen with reference to FIG. 5A, the coupler 200 has a coupling factor of approximately −20 dB over the frequency range of 700 MHz to 800 MHz. Specifically, the coupler 200 has a coupling factor of −20.3 dB at 707 MHz, indicated by marker 510. FIG. 5B illustrates a graph of the directivity (D) in dB of the coupler 200 as a function of frequency (in MHz) over the simulated frequency range. The directivity of the coupler (in dB) can be defined, in terms of the S parameters of the coupler as:

$$D = \frac{S(3,1)}{S(3,2)}\ \text{dB} \tag{3}$$

Figure 5C:
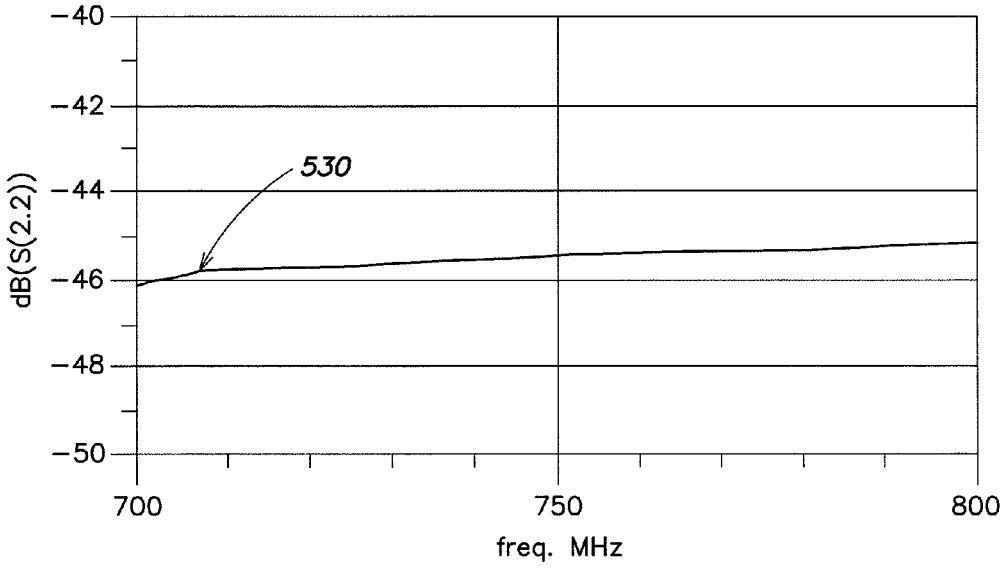
FIG. 5C is a graph of return loss as a function of frequency for the simulated conventional strip coupled coupler of FIG. 4.

As can be seen with reference to FIG. 5B, the coupler 200 has a directivity of approximately −30 dB over the frequency range of 700 MHz to 800 MHz. Specifically, the coupler 200 has a directivity of −30.431 dB at 707 MHz, indicated by marker 520. FIG. 5C illustrates a graph of the return loss (S(2,2)) in dB of the coupler 200 as a function of frequency (in MHz) over the simulated frequency range. As can be seen with reference to FIG. 5C, the coupler 200 has a return loss of approximately −45 dB over the frequency range of 700 MHz to 800 MHz. Specifically, the coupler 200 has a return loss of −45.752 dB at 707 MHz, indicated by marker 530.

Figure 6:
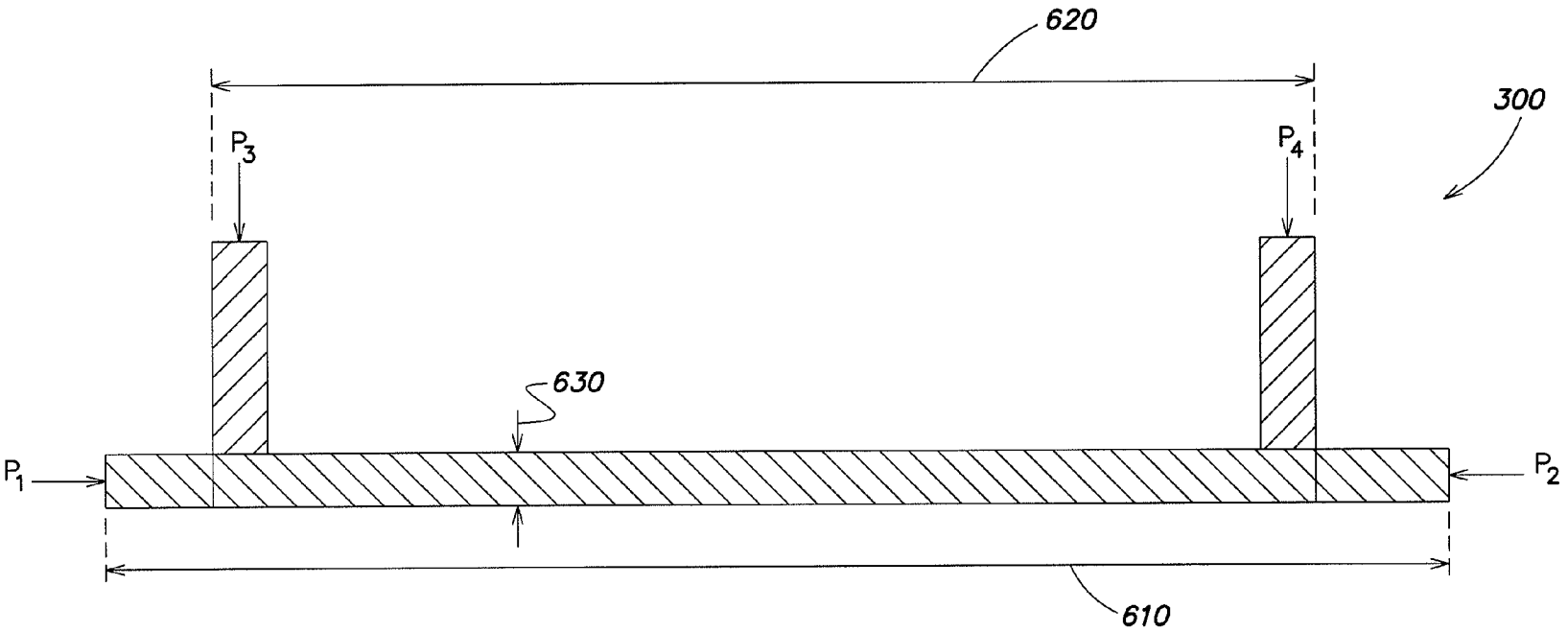
FIG. 6 is a simulation diagram of one example of sandwich strip coupled coupler according to aspects of the invention.
Figure 7A:
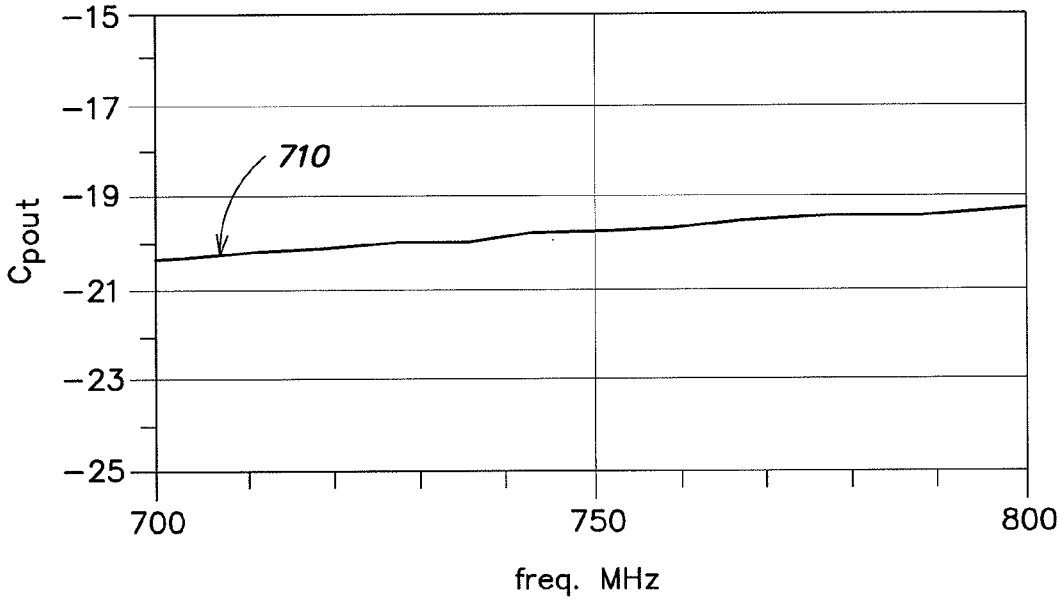
FIG. 7A is a graph of coupling factor as a function of frequency for the simulated sandwich strip coupled coupler of FIG. 6.
Figure 7B:
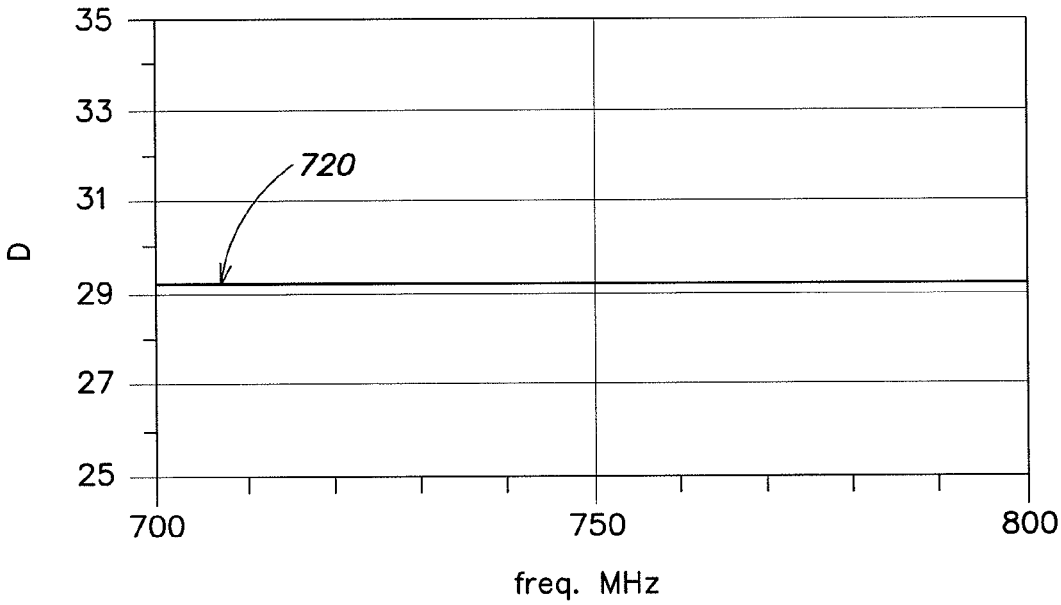
FIG. 7B is a graph of directivity as a function of frequency for the simulated sandwich strip coupled coupler of FIG. 6.
Figure 7C:
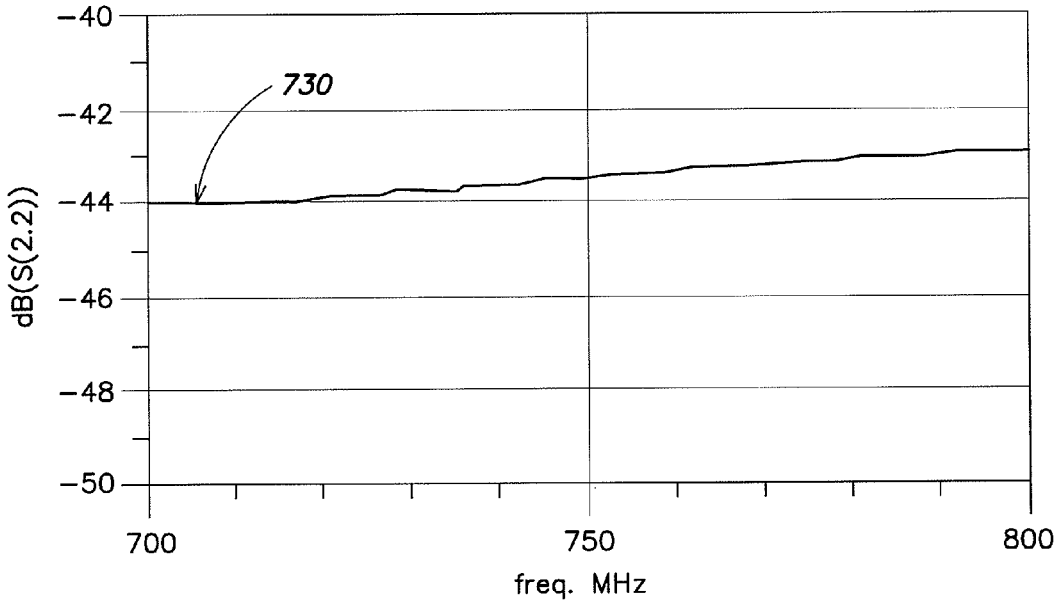
FIG. 7C is a graph of return loss as a function of frequency for the simulated sandwich strip coupled coupler of FIG. 6.

Referring to FIG. 6 there is illustrated a simulation diagram of a sandwich strip coupled coupler 300 according to one embodiment. The coupler 200 has an input port P1, a transmitted port P2, a coupled port P3 and an isolated port P4. The isolated port P4 may be terminated with a matched load. The simulation was run over the same frequency range 700 MHz-800 MHz discussed above, and the results are presented in FIGS. 7A-7C. For the simulation, the coupler 300 was specified as having a main arm length 610 of 2.3 mm and a coupled arm length 620 of 2.1 mm. FIG. 7A illustrates a graph of the coupling factor in dB ($C_{pout}$) of the simulated sandwich coupler 300 as a function of frequency (in MHz) over the simulated frequency range. As can be seen with reference to FIG. 7A, the sandwich coupler 300 has a coupling factor of approximately −20 dB over the frequency range of 700 MHz to 800 MHz. Specifically, the sandwich coupler 300 has a coupling factor of −20.266 dB at 707 MHz, indicated by marker 710. FIG. 7B illustrates a graph of the directivity (D) in dB of the sandwich coupler 300 as a function of frequency (in MHz) over the simulated frequency range. As can be seen with reference to FIG. 7B, the sandwich coupler 300 has a directivity of better than −29 dB over the frequency range of 700 MHz to 800 MHz, with a directivity of −29.185 dB at 707 MHz, indicated by marker 720. FIG. 7C illustrates a graph of the return loss (S(2,2)) in dB of the sandwich coupler 300 as a function of frequency (in MHz) over the simulated frequency range. As can be seen with reference to FIG. 7C, the sandwich coupler 300 has a return loss of approximately −43 to −44 dB over the frequency range of 700 MHz to 800 MHz, with a return loss of −43.955 dB at 707 MHz, indicated by marker 730.

The simulation results demonstrate that the sandwich strip coupled coupler can achieve a very similar coupling factor, directivity and return loss to a conventional strip coupled coupler with a substantially reduced size. The reduced coupler size allows integration of a high performance coupler with a small power amplifier module, even at lower frequencies. For example, a presently desirable size for a power amplifier module is approximately 3 mm by 3 mm. Embodiments of the sandwich strip coupled coupler 600 can be implemented within this size power amplifier module since, as discussed above with reference to FIG. 6, the transmission lines for the sandwich strip coupled coupler can be made substantially shorter than 3 mm and the coupler still provides good performance in the 700-800 MHz frequency band. In addition, because the main arm of the coupler 300 is implemented on two metal layers, to achieve similar metallization loss, the line width 630 can be made significantly smaller than the corresponding main line width 430 of a conventional coupler that has a single-layer main arm, given the same performance specifications, as can be seen with reference to FIGS. 4 and 6. The narrower line width 630 further reduces the size of the coupler 300 and the space that it uses in the substrate or printed circuit board package.

Having thus described several aspects of at least one embodiment, it is to be appreciated various alterations, modifications, and improvements will readily occur to those skilled in the art. Such alterations, modifications, and improvements are intended to be part of this disclosure and are intended to be within the scope of the invention. Accordingly, the foregoing description and drawings are by way of example only, and the scope of the invention should be determined from proper construction of the appended claims, and their equivalents.

The invention claimed is:

1. A sandwich strip coupled coupler comprising:

a main arm including a first main arm section and a second main arm section disposed above the first main arm section, the first and second main arm sections being electrically connected together in parallel; and a coupled arm disposed between the first and second main arm sections, the first main arm section, the coupled arm, and the second main arm section being vertically aligned with one another and forming a sandwich structure.

2. The sandwich strip coupled coupler of claim 1 further comprising at least one via that electrically connects the first and second main arm sections.

3. The sandwich strip coupled coupler of claim 2 wherein the sandwich strip coupled coupler is implemented in a multi-layer printed circuit board and the first main arm section is disposed in a first metal layer of the multi-layer printed circuit board, the second main arm section is disposed in a second metal layer of the multi-layer printed circuit board, the second metal layer disposed above the first metal layer, and the coupled arm is disposed in a third metal layer of the multi-layer printed circuit board, the third metal layer disposed above the first metal layer and below the second metal layer.

4. The sandwich strip coupled coupler of claim 2 wherein the at least one via includes a first via located proximate a proximal end of the first and second main arm sections, and a second via located proximate a distal end of the first and second main arm sections.

5. The sandwich strip coupled coupler of claim 4 further comprising an input port coupled to the proximal end of the first and second main arm sections and a transmitted port coupled to the distal end of the first and second main arm sections.

6. The sandwich strip coupled coupler of claim 1 wherein current flow in the first and second main arm sections is in a same direction.

7. A multi-layer strip coupled coupler comprising:

a first main arm section formed in a first metal layer in a multi-layer substrate;

a second main arm section formed in a second metal layer above the first metal layer in the multi-layer substrate, the second main arm section being vertically aligned with and electrically connected to the first main arm section;

a coupled arm formed in a third metal layer in the multi-layer substrate, the coupled arm disposed between the first and second main arm sections, the coupled arm being separated from the first main arm section by a first dielectric layer and separated from the second main arm section by a second dielectric layer;

a first via located proximate an input of the first main arm section that electrically connects the first and second main arm sections in parallel; and a second via located proximate a distal end, relative to the input, of the first and second main arm sections that electrically connects the first and second main arm sections in parallel.

8. The multi-layer strip coupled coupler of claim 7 wherein the multi-layer substrate is a multi-layer printed circuit board.

9. The multi-layer strip coupled coupler of claim 7 wherein the coupled arm is located between the first and second vias.

10. The multi-layer strip coupled coupler of claim 7 wherein current flow in the first and second main arm sections is in a same direction.

11. The multi-layer strip coupled coupler of claim 7 wherein the first and second main arm sections and the coupled arm are copper traces.

12. A strip coupled coupler formed in a multi-layer printed circuit board, the strip-coupled coupler comprising:

a first main line section formed in a first layer of the multi-layer printed circuit board;

a second main line section formed in a second layer of the multi-layer printed circuit board;

a coupled line formed in a third layer of the multi-layer printed circuit board, the third layer being disposed between the first and second layers and the coupled line being disposed between the first and second main line sections, and the coupled line, the first main line section, and the second main line section being vertically aligned; and at least one via that electrically connects the first main line section to the second main line section in parallel.

13. The strip coupled coupler of claim 12 wherein the first, second, and third layers are metal layers of the multi-layer printed circuit board.

14. The strip coupled coupler of claim 12 wherein the first and second main line sections and the coupled line are printed copper traces.

15. The strip coupled coupler of claim 12 wherein the at least one via includes a first via located proximate a proximal end of the first main line section and a second via located proximate a distal end of the first main line section.

16. The strip coupled coupler of claim 15 further comprising:

an input port coupled to the proximal end of each of the first main line section and the second main line section; and a coupled port coupled to a proximal end of the coupled line, the proximal end of the coupled line being at a same end of the strip coupled coupler as the proximal end of the first and second main line sections.

17. The strip coupled coupler of claim 16 further comprising:

a transmitted port coupled to the distal end of the first and second main line sections; and an isolated port coupled to a distal end of the coupled line.

18. The strip coupled coupler of claim 17 wherein current flow in the first and second main line sections is in a same direction from the input port to the transmitted port.

19. The strip coupled coupler of claim 17 further comprising a matched load coupled to the isolated port.

20. The strip coupled coupler of claim 15 wherein the coupled line is located between the first and second vias.

* * * * *